US009020765B2

(12) United States Patent
Seebauer

(10) Patent No.: US 9,020,765 B2
(45) Date of Patent: Apr. 28, 2015

(54) SAFETY SYSTEM IN AND METHOD FOR THE OPERATION OF A COMBUSTION DEVICE

(75) Inventor: Manfred Seebauer, Aveiro (PT)

(73) Assignee: ebm-papst Landshut GmbH, Landshut (DE)

( * ) Notice: Subject to any disclaimer, the term of this patent is extended or adjusted under 35 U.S.C. 154(b) by 1110 days.

(21) Appl. No.: 13/058,166

(22) PCT Filed: Aug. 12, 2009

(86) PCT No.: PCT/EP2009/060435

§ 371 (c)(1),
(2), (4) Date: Feb. 8, 2011

(87) PCT Pub. No.: WO2010/018192

PCT Pub. Date: Feb. 18, 2010

(65) Prior Publication Data

US 2011/0137579 A1 Jun. 9, 2011

(30) Foreign Application Priority Data

Aug. 13, 2008 (DE) ..... 10 2008 038 949

(51) Int. Cl.

| | |
|---|---|
| ***G01F 1/78*** | (2006.01) |
| ***G01F 3/24*** | (2006.01) |
| ***F23N 3/08*** | (2006.01) |
| ***F23N 5/18*** | (2006.01) |
| ***F23N 5/24*** | (2006.01) |

(52) U.S. Cl.

CPC ..... *F23N 3/082* (2013.01); *F23N 5/184* (2013.01); *F23N 5/242* (2013.01); *F23N 2005/181* (2013.01); *F23N 2031/10* (2013.01); *F23N 2033/08* (2013.01)

(58) Field of Classification Search

CPC ..... G01F 1/78; G01F 1/64; G01F 1/20; G01F 1/86; G01F 1/206; G01F 25/0007; G01F 25/53; G01F 1/74; G01F 1/76; G01F 1/8436; G01F 3/24

USPC ..... 702/45

See application file for complete search history.

(56) References Cited

U.S. PATENT DOCUMENTS

| | | | | | |
|---|---|---|---|---|---|
| 4,856,321 | A * | 8/1989 | Smalling et al. | ..... | 73/40.5 A |
| 5,658,140 | A * | 8/1997 | Kondou et al. | ..... | 431/90 |
| 5,997,280 | A * | 12/1999 | Welz et al. | ..... | 431/90 |
| 6,247,919 | B1 * | 6/2001 | Welz et al. | ..... | 431/13 |
| 6,527,541 | B2 * | 3/2003 | Lochschmied | ..... | 431/25 |

(Continued)

FOREIGN PATENT DOCUMENTS

| | | |
|---|---|---|
| DE | 10159033 A | 9/2002 |
| DE | 102004055715 | 1/2006 |

(Continued)

*Primary Examiner* — John Breene
*Assistant Examiner* — Lynda Dinh
(74) *Attorney, Agent, or Firm* — Harness, Dickey & Pierce, P.L.C.

(57) ABSTRACT

A system and a method for safe operations of a mass flow sensor in a combustion device, with a gas supply, an air supply, a fan with an electric motor, a burner, and a communication micro processor, wherein the mass flow sensor includes a microprocessor used for communications, the communication micro processor communicates with the micro processor of the one mass flow sensor, and the communications include safety-relevant interrogations of the mass flow sensor in order to secure the mass flow sensor.

23 Claims, 3 Drawing Sheets

(56) References Cited

U.S. PATENT DOCUMENTS

Figure 1A:
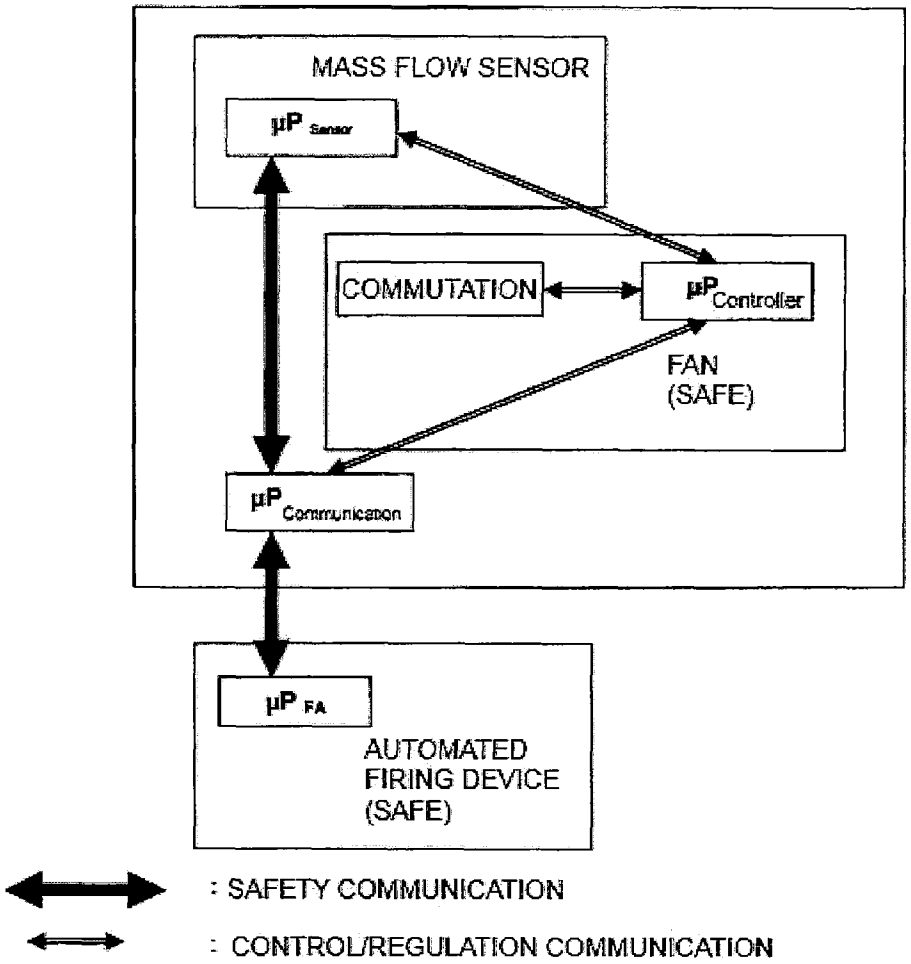

| | | | | |
|---|---|---|---|---|
| 7,003,939 | B1 * | 2/2006 | Rackwitz et al. | 60/786 |
| 7,824,177 | B2 * | 11/2010 | Takasu et al. | 431/29 |
| 8,070,423 | B2 * | 12/2011 | Vogel et al. | 415/118 |
| 2008/0138750 | A1 | 6/2008 | Kim | |
| 2009/0044634 | A1 * | 2/2009 | Weilguny et al. | 73/861.09 |

FOREIGN PATENT DOCUMENTS

| | | | |
|---|---|---|---|
| DE | 102004055716 | | 1/2006 |
| EP | 0724122 | A | 7/1996 |
| WO | WO2006/080612 | A | 8/2006 |

* cited by examiner

SAFETY SYSTEM IN AND METHOD FOR THE OPERATION OF A COMBUSTION DEVICE

FIELD

The invention relates to a system for safe operations of a mass flow sensor in a combustion device with a gas supply, an air supply, a fan with an electric motor, a burner, and a communication micro processor. Furthermore, the present disclosure relates to a method for safe operations of the combustion device which includes the gas supply, the air supply, the fan with the electric motor, the burner, an automated firing device to control or regulate operations, and the mass flow sensor to measure an air mass flow.

BACKGROUND

The use of mass flow sensors in the field of combustion devices is known in the art, for example from DE 10 2004 055 715 or DE 10 2004 055 716. Thus, air mass flow sensors are used in an electronic interconnection or a system with a constant lambda for premixing gas heaters, in which a combustible gas-air mixture is created in front of the fan and fed by the fan. The mass flow sensors are safety-critical for the systems recited supra and therefore have to be maintained in a defined safe condition. The safety is based on an occurrence of fault conditions and is divided into classes according to the standard ENV 14459:2002. Mass flow sensors for gas heaters have to comply with class C.

In principle the safety of sensors can be achieved through a redundant embodiment. Thus it is disadvantageous that at least two sensors are provided for a measurement variable, which causes substantial costs especially in high-volume production. Thus, it is more economical to provide only one sensor and to ensure the necessary safety through monitoring the sensor.

Thus, the object of the disclosure is to provide a system architecture for a cost-optimized connection of a safe mass flow sensor to an automated firing device.

SUMMARY

This object is achieved through a system and a method with the features of claims 1 and 15.

The system according to the disclosure for safe operations of a mass flow sensor in a combustion device is characterized in that the at least one mass flow sensor includes at least one micro processor, which is also used for safety communications, the communications processor communicates with the at least one micro processor of the mass flow sensor, wherein safety communications involve safety-relevant interrogations of the mass flow sensor in order to secure the mass flow sensor.

The micro processor of the mass flow sensor according to claim 1 is "also" intended for the safety communications. This means that the microprocessor, beside its tasks that are known in the pertinent art (measuring the mass flow and communicating a measured value of a control or regulation device), additionally performs safety communications in order to secure the mass flow sensor.

Preferably, but without limitation, the mass flow sensor according to the present disclosure is an air mass flow sensor which is used for detecting an air mass supplied to the combustion device. In an advantageous embodiment of the disclosure, the mass flow sensor can include a microprocessor to compute the air mass, wherein the microprocessor can also communicate with the communication microprocessor.

It is also advantageous for the system according to the disclosure to include a connection to an automated firing device. Thus, the automated firing device can include a micro processor, which corresponds to the communication micro processor in a possible embodiment. Furthermore it is advantageous in an alternative embodiment to arrange the communication micro processor in the direct proximity of the air mass flow sensor, wherein a particularly advantageous embodiment includes arranging the communication micro processor at the fan, in particular at the motor of the fan. In an advantageous embodiment the communication micro processor can furthermore include a safety kernel, through which safety-relevant communications are provided.

Another embodiment of the disclosure uses a configuration, wherein the air mass flow sensor is configured as an integral unit sensor with the fan and with the communication micro processor, wherein the integral unit can be connected with the automated firing device through a digital interface. Thus, the digital interface is used for the safety-relevant safety communications between the unit, including air mass flow sensor, fan and communication micro processor, and the automated firing device.

In another advantageous embodiment of the present disclosure the fan includes at least one microprocessor, for example a controller with a micro processor, which commutates the drive motor of the fan.

In another advantageous embodiment the at least one micro processor includes at least one air mass flow sensor and the communication micro processor includes a digital connection.

In an alternative embodiment the at least one air mass flow sensor can be configured as a unit with the automated firing device including the fan and the communication micro processor.

Safety-relevant safety communications through the digital interface includes transmitting safety-relevant signals, which are preferably periodically at defined time intervals or continuously through interrogation. Interrogation includes for example plausibility checks, which can be carried out e.g. as arithmetic problems like a comparison of memory contents or similar.

Furthermore the disclosure provides a method which provides safe operations for a combustion device, in particular a gas burner, with a gas supply, an air supply, a fan with an electric motor, a burner, and an automated firing device for controlling or regulating operations, wherein at least one mass flow sensor is arranged at least in the air supply to measure the air mass flow. The method is characterized in that the air mass flow sensor, in addition to the air mass flow signal, provides safety-relevant signals in response to interrogation signals or continuously. Thus, it is particularly advantageous that the interrogation signals can be emitted by a communication micro processor and the safety signals can be processed by the communication micro processor.

In an alternative embodiment the communication micro processor can be integrated in the automated firing device. Furthermore, the advantageous system architecture embodiments recited supra apply in their entirety to the method according to the disclosure.

DRAWINGS

Other advantages of the disclosure are described infra with reference to an advantageous embodiment of the disclosure based on drawing figures.

Figure 1B:
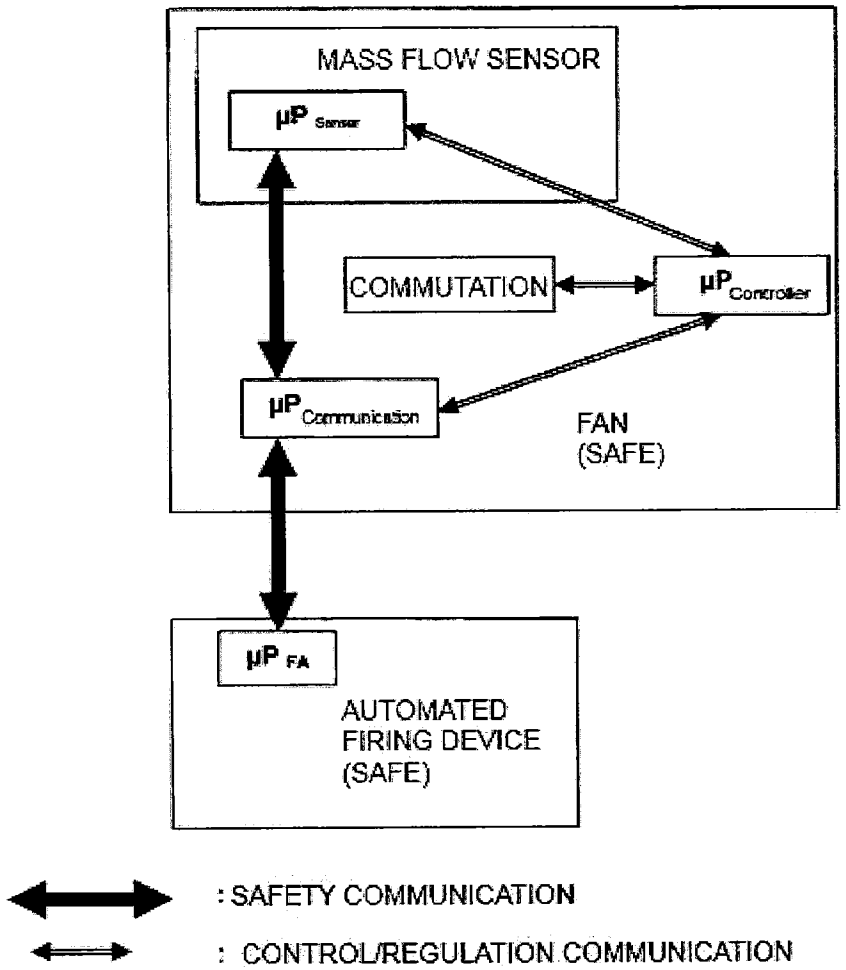
Figure 2:
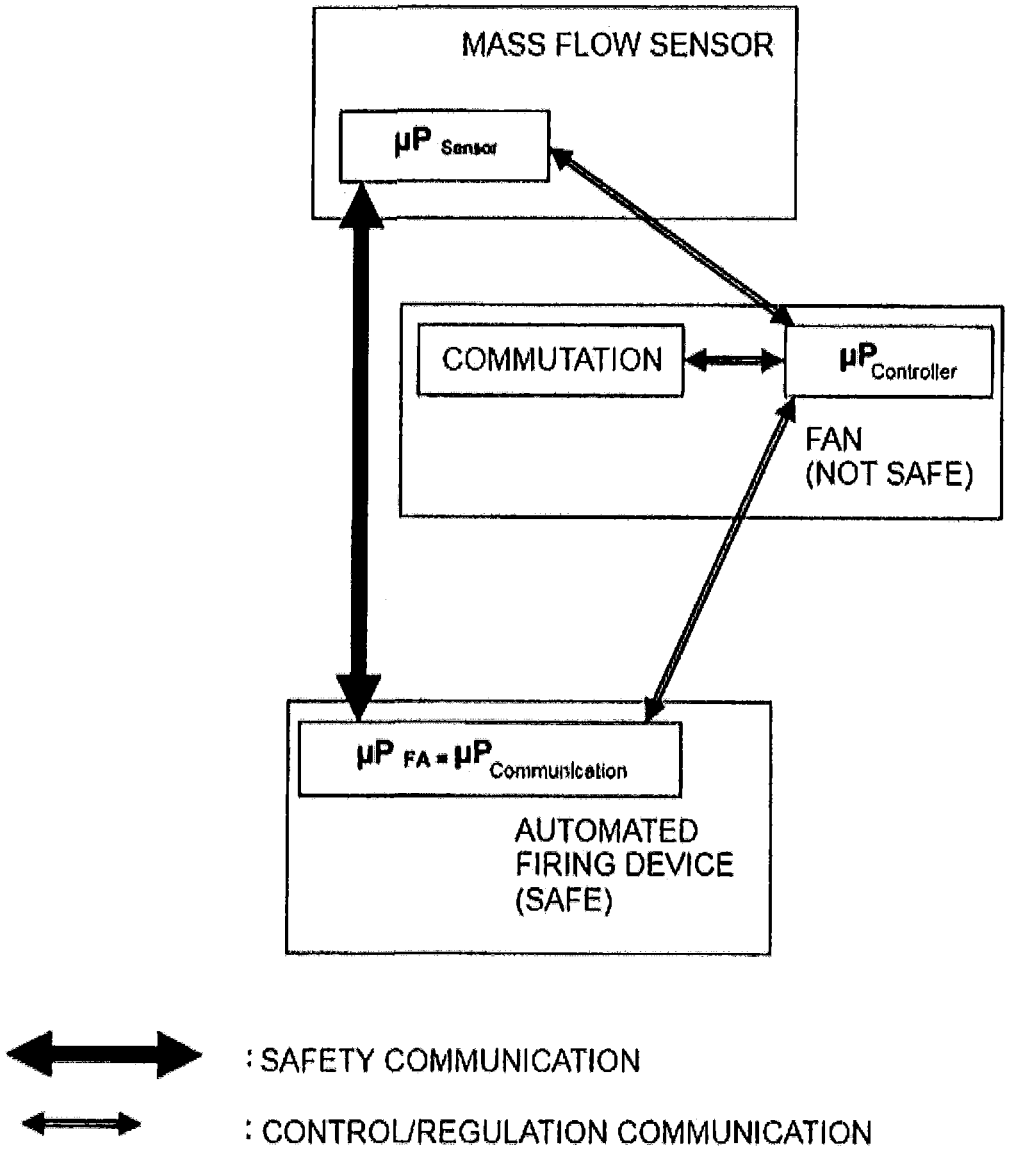

The illustrations in the appended figures are exemplary and schematic. Furthermore, only elements that are essential for understanding the disclosure are depicted in the drawing figures, wherein FIG. 1*a* illustrates a first schematic depiction of an embodiment of the disclosure with a separate automated firing device;

FIG. 1*b* illustrates a second schematic depiction of an embodiment of the disclosure with a separate automated firing device; and FIG. 2 illustrates a schematic depiction of an embodiment of the disclosure with an integrated automated firing device.

DESCRIPTION

FIG. 1*a* illustrates a system for safe operations of a mass flow sensor in a combustion device according to a first embodiment of the disclosure. A mass flow sensor, which is preferably configured as an air mass flow sensor, forms a unit with a fan, which is operated through an electric motor, and with a communication micro processor, wherein the unit is connectable to a digital interface with a separately arranged automated firing device. A unit in the sense of the disclosure stands for various components, which can also be connected only with cables. The air mass flow sensor includes a micro processor, $\mu P_{Sensor}$, used for a safety communications, wherein the micro processor can communicate with a communication micro processor, $\mu P_{Communication}$ that is part of the unit. Furthermore the micro processor $\mu P_{Sensor}$ of the air mass flow sensor is used for detecting and computing a current air mass flow. The detected value is transmitted to the micro processor of the fan $\mu P_{Controller}$ through a control- or regulation communication, in order to control or regulate the speed of the fan through the commutation. In the illustrated embodiment the communication micro processor is disposed directly proximal to the air mass flow sensor, however, it is also possible to arrange the communication micro processor directly at the fan, in particular at the motor of the fan (cf. FIG. 2). Besides the microprocessor $\mu P_{Controller}$, the fan includes a commutation, which can also be optionally configured with a micro processor of its own. The microprocessor $\mu P_{Controller}$ is connected to the communication micro processor $\mu P_{Communication}$, wherein the drive motor of the fan is commutated through the microprocessor $\mu P_{Controller}$ and the commutation. The communication micro processor $\mu P_{Communication}$ includes a safety kernel in order to implement the safety-relevant communication with the automated firing device and also to assure the safety of the air mass flow sensor through particular periodical interrogations (safety communication). For safe operation of the air mass flow sensor it is provided that the communication processor $\mu P_{Communication}$ communicates with the micro processor of the air mass flow sensor $\mu P_{Sensor}$ through a digital interface, that the safety-relevant interrogations are transmitted to the mass flow sensor in order to thus provide safe operations of the mass flow sensor without having to configure the mass flow sensor in a redundant manner. Safety-relevant interrogations according to the disclosure are typically performed frequently in defined time intervals or continuously and include the transmission of safety-relevant signals, wherein e.g. test runs, plausibility tests, or other checks of the function of the mass flow sensor have to be performed which are known in the art.

The automated firing device that is arranged separate from the unit is safe and includes a micro processor $\mu P_{FA}$, which communicates with the unit through the digital interface. The automated firing device corresponds to the portion of safety-relevant processing of the signals provided by the air mass flow sensor and the fan. Thus, a communication of the communication micro processor $\mu P_{Communication}$ is provided both between the micro processor of the mass flow sensor $\mu P_{Sensor}$ and the micro processor of the automated firing device $\mu P_{FA}$. By providing an additional communication micro processor, the mass flow sensor is secured through safety communications.

FIG. 1*b* illustrates a second embodiment of the system according to the disclosure according to FIG. 1*a*, wherein the communication micro processor is arranged directly at the fan and the mass flow sensor is arranged at least in the direct proximity of the fan. Providing a communication micro processor secures the mass flow sensor and the fan through safety communication.

FIG. 2 illustrates an embodiment according to the disclosure, wherein the air mass flow sensor is configured as a unit with the fan and with the automated firing device. The unit provides a demarcation of the safety relevance of the mass flow signal, which also includes the automated firing device. The communication micro processor $\mu P_{Communication}$ is thus integrated in the automated firing device, so that the additional micro processor required for the embodiment according to FIGS. 1*a* and 1*b* can be saved. The safety-relevant communication takes place within the unit. The safety kernel of the communication micro processor $\mu P_{Communication}$ transmits interrogations, as for the embodiment according to FIGS. 1*a* and 1*b*, periodically in defined time intervals or continuously in form of safety-relevant signals to the micro processor of the air mass flow sensor $\mu P_{Sensor}$. Also for an embodiment of this type, the fan can include a processor $\mu P_{Controller}$ as well as a commutation with an optional micro processor of its own, through which the commutation of the fan is regulated and thus the air mass required for the gas heater is adjusted.

The embodiments according to FIG. 1*a* and 1*b* of the system for safe operations of the mass flow sensor are provided for combustion devices, wherein the automated firing device is provided as a separate unit, e.g. from different manufacturers, wherein the system can be integrated for safe operations according to the disclosure. Thus, any automated firing devices with a micro processor can be retrofitted with a unit according to FIG. 1*a* and 1*b* to provide a safe mass flow sensor. The embodiment of the disclosure illustrated in FIG. 2 is an integrated solution, wherein the system or the unit including the mass flow sensor, the fan and the automated firing device, can be provided from one source, wherein an additional communication micro processor in the direct proximity of the air mass flow sensor or at the fan is not required, since the micro processor of the automated firing device can undertake the task additionally, which in turn saves money.

The invention claimed is:

1. A system for safe operation of at least one mass flow sensor, the system comprising:

a combustion device having at least one mass flow sensor;

a gas supply to the combustion device, an air supply to the combustion device, the combustion device including a fan, an electric motor driving the fan, a burner, and a communication micro processor, wherein a digital interface is provided for the safety communications with an automated firing device, wherein the safety communications include transmission of safety-relevant signals, wherein the at least one mass flow sensor includes at least one mass flow micro processor, the communication micro processor performs a safety communication with the at least one mass flow micro processor of the at least one mass flow sensor, and the safety communication includes communicating safety-relevant interrogations of the at least one mass flow sensor with the at least one mass flow micro processor in order to secure safe operation of the at least one mass flow sensor, and the safety-relevant interrogations check an operation of the at least one mass flow sensor.

2. The system according to claim 1 including an automated firing device, wherein the communication micro processor is integrated into the automated firing device.

3. The system according to claim 1, wherein the communication micro processor is arranged adjacent the air mass flow sensor.

4. The system according to claim 1, wherein the communication micro processor is arranged at the electric motor driving the fan.

5. The system according to claim 1, wherein the at least one mass flow sensor is configured as an air mass flow sensor.

6. The system according to claim 1, wherein the at least one micro processor is used for calculating air mass.

7. The system according to claim 1, wherein interrogations are performed periodically in defined time intervals or continuously.

8. The system according to claim 1, wherein the communication micro processor includes a safety kernel.

9. The system according to claim 1, wherein the at least one air mass flow sensor is configured as a unit with the fan and with the communication micro processor.

10. The system according to claim 1, wherein the fan includes at least one controller with a fan micro processor which commutates with the electric motor driving the fan.

11. The system according to claim 1, wherein the at least one mass flow micro processor of the at least one mass flow sensor and the communication micro processor include a digital connection.

12. The system according to claim 1, wherein the at least one mass flow sensor is configured as a unit with the fan and an automated firing device including the communication micro processor.

13. A method for safe operations of a combustion device, the method comprising:

providing a gas supply to the combustion device, providing an air supply to the combustion device, providing a fan for the combustion device providing an electric motor to drive the fan, providing a gas burner for the combustion device, providing an automated firing device for controlling or regulating operations of the combustion device, wherein a digital interface is provided for the safety communications with an automated firing device, wherein the safety communications include transmission of safety-relevant signals, providing at least one mass flow sensor for measuring an air mass flow arranged at least in the air supply, performing a safety communication with the at least one mass flow sensor, wherein the safety communication includes communicating safety-relevant interrogations with the at least one mass flow sensor to secure safe operation of the at least one mass flow sensor, and the safety-relevant interrogations check an operation of the at least one mass flow sensor, and receiving from the at least one mass flow sensor safety-relevant signals in response to the safety-relevant interrogation signals and air mass flow signals.

14. The method according to claim 13, wherein the interrogation signals are output by a communication processor and the safety-relevant signals are processed by the communication processor.

15. The method according to claim 14, wherein the communication processor is integrated in an automated firing device.

16. The method according to claim 14, wherein the communication processor is arranged adjacent the air mass flow sensor.

17. The method according to claim 14, wherein the communication processor is arranged at the electric motor driving the fan.

18. The method according to claim 14, wherein at least one mass flow micro processor of the at least one air mass flow sensor and the communication micro processor include a digital connection.

19. The method according to claim 13, wherein interrogation is performed periodically in defined time intervals or continuously.

20. The method according to claim 13, wherein the communication micro processor includes a safety kernel.

21. The method according to claim 13, wherein the at least one air mass flow sensor is configured as a unit with the fan and the communication micro processor.

22. The method according to claim 13, wherein the fan includes at least one micro processor which commutates with the electric motor driving the fan.

23. The method according to claim 13 wherein the at least one air mass flow sensor is configured as a unit with the fan and with an automated firing device including a communication micro processor.

* * * * *